US005882831A

United States Patent [19]

Fuller et al.

[11] Patent Number: 5,882,831

[45] Date of Patent: Mar. 16, 1999

[54] ACID DOPING LATITUDE ENLARGEMENT FOR PHOTORECEPTORS

[75] Inventors: Timothy J. Fuller, Pittsford; Damodar M. Pai; Markus R. Silvestri, both of Fairport; John F. Yanus, Webster; Timothy L. Lincoln, Rochester; David J. Maty, Ontario; Kathleen M. Carmichael, Williamson, all of N.Y.

[73] Assignee: Xerox Corporation, Stamford, Conn.

[21] Appl. No.: 181,625

[22] Filed: Oct. 28, 1998

[51] Int. Cl.[6] ..... G03G 5/047

[52] U.S. Cl. ..... 430/59; 430/58; 430/132

[58] Field of Search ..... 430/58, 59, 132

[56] References Cited

U.S. PATENT DOCUMENTS

| | | | |
|---|---|---|---|
| 4,265,990 | 5/1981 | Stolka et al. | 430/59 |
| 4,725,518 | 2/1988 | Carmichael et al. | 430/58 |
| 5,149,612 | 9/1992 | Langlois et al. | 430/132 |
| 5,356,741 | 10/1994 | Carmichael et al. | 430/56 |
| 5,492,785 | 2/1996 | Normandin et al. | 430/58 |

*Primary Examiner*—Roland Martin

[57] ABSTRACT

An electrophotographic imaging member comprising a charge generating layer comprising trigonal selenium particles and a charge transport layer, the charge transport layer including a protonic acid or Lewis acid a charge transporting small molecule, a film forming polymer, and an additive selected from the group consisting of 1-alkylpiperidene, triethylamine, a complex of 1-alkylpiperidene and a protonic acid or Lewis acid, a complex of triethylamine and a protonic acid or Lewis acid and mixtures thereof.

This imaging member may be fabricated using a solvent for applying the charge transport layer.

18 Claims, No Drawings

ACID DOPING LATITUDE ENLARGEMENT FOR PHOTORECEPTORS

BACKGROUND OF THE INVENTION

This invention relates in general to electrophotographic imaging members and more specifically, to imaging members having an improved acid doped charge transport layer and process for fabricating the imaging members.

In the art of electrophotography an electrophotographic plate comprising a photoconductive insulating layer on a conductive layer is imaged by first uniformly electrostatically charging the imaging surface of the photoconductive insulating layer. The plate or photoreceptor is then exposed to a pattern of activating electromagnetic radiation such as light, which selectively dissipates the charge in the illuminated areas of the photoconductive insulating layer while leaving behind an electrostatic latent image in the non-illuminated area. This electrostatic latent image may then be developed to form a visible image by depositing finely divided toner particles on the surface of the photoconductive insulating layer. The resulting visible toner image can be transferred to a suitable receiving member such as paper. This imaging process may be repeated many times with reusable photoconductive insulating layers.

One common type of photoreceptor is a multilayered device that comprises a conductive layer, a charge generating layer, and a charge transport layer. Either the charge generating layer or the charge transport layer may be located adjacent the conductive layer. The charge transport layer can contain an active aromatic diamine small molecule charge transport compound dissolved or molecularly dispersed in a film forming binder. This type of charge transport layer is described, for example in U.S. Pat. No. 4,265,990. Although excellent toner images may be obtained with such multilayered photoreceptors, it has been found that acid doping of the charge transport layer enhanced predictability of performance for high precision copiers, duplicators and printers having narrow sensitivity windows. This acid doping is described, for example in U.S. Pat. No. 4,725,518, U.S. Pat. No. 5,149,612 and U.S. Pat. No. 5,356,741, the entire disclosures of these patents being incorporated herein by reference. This acid doping overcame the unpredictable variations in electrical performance of photoreceptors made from commercially available methylene chloride and polycarbonate that contained impurities that fluctuated from batch to batch and from the batch to batch variabilities of the generator layer pigment. Acid doping is preferably accomplished by combining transport layer solutions from two different pots (one doped with a very low amount of acid and the second doped with a higher concentration of acid) are mixed just prior to the introduction of the coating solution into the coating die. The amount of material from the second pot is adjusted continuously to bring electrical characteristics to the desired level. Surprisingly, with the passage of time, the optimum amount of acid used for doping diminished to about 3 ppm based on the weight of methylene chloride, due, probably, to unknown material and/or process changes pertaining to synthesis of the commercially available methylene chloride solvent and/or other components in the charge transport layer such as the polycarbonate film forming binder.

As doping was reduced to lower levels, the resulting photoreceptors began to exhibit "edge spikes" in which some regions of the photoreceptors have higher background potential (lower sensitivities) resulting in dark background print out in these regions. The loss in sensitivity along the edges occurs in a periodic pattern. The edge spike becomes less prominent if the doping acid, such as trifluoroacetic acid (TFA), concentration is increased to more than about 10 ppm, based on the weight of methylene chloride. However, when the concentration of TFA is increased to more than about 20 ppm in the photoreceptors, the photoreceptors show increased depletion, higher dark decay and long term cyclic instability.

Thus it is desirable to have a quality control tool such as acid doping that can be varied during the manufacturing and yet have the acid concentration stay between about 5 and about 15 ppm based on the weight of methylene chloride.

INFORMATION DISCLOSURE STATEMENT

U.S. Pat. No. 4,725,518 to Carmichael et al., issued Feb. 16, 1988—A process for preparing an electrophotographic imaging member is disclosed comprising providing a photogenerating layer on a supporting substrate and applying a charge transport layer forming mixture to the photogenerating layer, the charge transport layer forming mixture comprising a charge transporting aromatic amine compound of one or more compounds having certain specified general formula, a polymeric film forming resin in which the aromatic amine is soluble, solvent for the polymeric film forming resin, and from about 1 part per million to about 10,000 parts per million, based on the weight of the aromatic amine, of a protonic acid or Lewis acid having a boiling point greater than about 40° C. and soluble in the solvent.

U.S. Pat. No. 5,149,612 to Langlois et al., issued Sep. 22, 1992—Processes and apparatus for fabricating an electrophotographic imaging member are disclosed in which a web coated with a charge generation layer is coated with a charge transport layer comprising a dopant, the improvement comprising detecting the change in dopant concentration required, determining the amount of highly doped charge transport composition and amount of undoped or lowly doped charge transport composition required to achieve the change in dopant concentration, feeding the determined amounts of highly doped charge transport composition and undoped or lowly doped charge transport composition into a mixing zone, rapidly mixing the amounts of highly doped charge transport composition and undoped or lowly doped charge transport composition to form a uniformly doped charge transport composition, and applying the uniformly doped charge transport composition to the charge generation layer.

U.S. Pat. No. 5,356,741 to Carmichael et al., issued Oct. 18, 1994—A method of controlling variations in electrical characteristics in electrophotographic imaging devices by eliminating the effect of acidic or basic impurities in a photoconductive element. A solution of a weak acid or weak base and a conjugate salt of the weak acid and the weak base is incorporated into a layer of the photoconductive element. In a process for producing the photoconductive element, a substrate is coated with a first dispersion to form a charge generating layer, and then coated with a second dispersion to form a charge transporting layer, wherein there is incorporated in at least one of the first and second dispersions a solution of a weak acid or weak base and the conjugate salt of the weak acid and weak base in an amount effective to reduce variations in the dark development potential ($V_{DDP}$) and background potential ($V_{BG}$) characteristics of the imaging devices.

U.S. Pat. No. 4,265,990, issued to Stolka et al. on May 5, 1981—A photosensitive member is disclosed having photoconductive layer and a charge transport layer, the charge transport layer containing an aromatic diamine in an inactive film forming binder.

CROSS REFERENCE TO COPENDING APPLICATIONS

U.S. patent application Ser. No. 09/181,451, filed concurrently herewith, in the names of Fuller et al., entitled "IMPROVED CHARGE TRANSPORT LAYER AND PROCESS FOR FABRICATING THE LAYER"—An electrophotographic imaging member is disclosed comprising a charge generating layer comprising trigonal selenium particles and a charge transport layer, the charge transport layer including a protonic acid or Lewis acid, a charge transporting small molecule, a film forming polymer, and polyalkylene-block-polyethylene oxide.

This imaging member may be fabricated using a suitable solvent for applying the charge transport layer.

Excellent toner images may be obtained with multilayered photoreceptors having acid doped charge transport layers with acid concentration in the range of 5 to 15 ppm based on the weight of methylene chloride. However, it has been found that the sensitivity of the device increases with the acid concentration with the highest rate of change of sensitivity occurring in the range of 0 to 5 ppm acid and the rate slowing down beyond 5 ppm. In the manufacturing process, if the acid concentration required to be within a predetermined sensitivity level is less than 5 ppm acid, any non-uniformity in the mixing of the transport layer results in sensitivity variations along the width of the photoreceptor. When the acid doping concentration is higher than 5 ppm, the variation of sensitivity with acid is not as pronounced and non uniform mixing of the transport layer gives rise to only small variabilities in the sensitivity along the width of the photoreceptor. This results in more rejects which in turn decreases the yield when the acid doping concentration is less than 5 ppm. Furthermore when such a photoreceptor is cycled in a xerographic machine, edge spikes occur thereby creating unacceptable images.

Thus, there is a continuing need for electrophotographic imaging members having improved electrical characteristics.

BRIEF SUMMARY OF THE INVENTION

It is, therefore, an object of the present invention to provide an improved electrophotographic imaging member which overcomes the above-noted disadvantages.

It is another object of the present invention to provide an electrophotographic imaging member which avoids edge spikes.

It is still another object of the present invention to provide an electrophotographic imaging member which contains higher proportions of doping acid.

It is yet object of the present invention to provide an electrophotographic imaging member possessing improved latitude for transport layer materials.

It is another object of the present invention to provide an electrophotographic imaging member that exhibits improved latitude for methylene chloride purity fluctuations.

It is still another object of the present invention to provide an electrophotographic imaging member that exhibiting greater latitude for polycarbonate purity fluctuations.

The foregoing objects and others are accomplished in accordance with this invention by providing an electrophotographic imaging member comprising a charge generating layer comprising trigonal selenium particles and a charge transport layer, the charge transport layer comprising a protonic acid or Lewis acid, a charge transporting small molecule, a film forming polymer, and an additive selected from the group consisting of 1-alkylpiperidene, triethylamine, a complex of 1-alkylpiperidene and a protonic acid or Lewis acid, a complex of triethylamine and a protonic acid or Lewis acid and mixtures thereof.

This imaging member may be fabricated using a suitable solvent for applying the charge transport layer.

Electrostatographic imaging members are well known in the art. Electrostatographic imaging members may be prepared by various suitable techniques. Typically, a flexible or rigid substrate is provided having an electrically conductive surface. A charge generating layer is then applied to the electrically conductive surface. A charge blocking layer may be applied to the electrically conductive surface prior to the application of the charge generating layer. If desired, an adhesive layer may be utilized between the charge blocking layer and the charge generating layer. Usually the charge generation layer is applied onto the blocking layer and a charge transport layer is formed on the charge generation layer. However, in some embodiments, the charge transport layer is applied prior to the charge generation layer.

The substrate may be opaque or substantially transparent and may comprise numerous suitable materials having the required mechanical properties. Accordingly, the substrate may comprise a layer of an electrically non-conductive or conductive material such as an inorganic or an organic composition. As electrically non-conducting materials there may be employed various resins known for this purpose including polyesters, polycarbonates, polyamides, polyurethanes, and the like which are flexible as thin webs. The electrically insulating or conductive substrate may be in the form of an endless flexible belt, a web, a rigid cylinder, a sheet and the like.

The thickness of the substrate layer depends on numerous factors, including strength desired and economical considerations. Thus, this layer for a flexible belt may be of substantial thickness, for example, about 125 micrometers, or of minimum thickness less than 50 micrometers, provided there are no adverse effects on the final electrostatographic device.

The conductive layer may vary in thickness over substantially wide ranges depending on the optical transparency and degree of flexibility desired for the electrostatographic member. Accordingly, for a flexible photoresponsive imaging device, the thickness of the conductive layer may be between about 20 angstrom units to about 750 angstrom units, and more preferably from about 100 Angstrom units to about 200 angstrom units for an optimum combination of electrical conductivity, flexibility and light transmission. The flexible conductive layer may be an electrically conductive metal layer formed, for example, on the substrate by any suitable coating technique, such as a vacuum depositing technique. Typical metals include aluminum, zirconium, niobium, tantalum, vanadium and hafnium, titanium, nickel, stainless steel, chromium, tungsten, molybdenum, and the like. In general, a continuous metal film can be attained on a suitable substrate, e.g. a polyester web substrate such as Mylar available from E. I. du Pont de Nemours & Co. with magnetron sputtering.

If desired, an alloy of suitable metals may be deposited. Typical metal alloys may contain two or more metals such as zirconium, niobium, tantalum, vanadium and hafnium, titanium, nickel, stainless steel, chromium, tungsten, molybdenum, and the like, and mixtures thereof.

After formation of an electrically conductive surface, a hole blocking layer may be applied thereto for photoreceptors. Generally, electron blocking layers for positively charged photoreceptors allow holes from the imaging surface of the photoreceptor to migrate toward the conductive layer. Any suitable blocking layer capable of forming an electronic barrier to holes between the adjacent photoconductive layer and the underlying conductive layer may be utilized. The blocking layer may be nitrogen containing siloxanes or nitrogen containing titanium compounds such as trimethoxysilyl propylene diamine, hydrolyzed trimethoxysilyl propyl ethylene diamine, N-beta-(aminoethyl) gamma-aminopropyl trimethoxy silane, isopropyl 4-aminobenzene sulfonyl, di(dodecylbenzene sulfonyl) titanate, isopropyl di(4-aminobenzoyl)isostearoyl titanate, isopropyl tri(N-ethylaminoethylamino)titanate, isopropyl trianthranil titanate, isopropyl tri(N,N-dimethylethylamino) titanate, titanium-4-amino benzene sulfonat oxyacetate, titanium 4-aminobenzoate isostearate oxyacetate, $[H_2N(CH_2)_4]CH_3Si(OCH_3)_2$, (gamma-aminobutyl) methyl diethoxysilane, and $[H_2N(CH_2)_3]CH_3Si(OCH_3)_2$ (gamma-aminopropyl) methyl diethoxysilane, as disclosed in U.S. Pat. Nos. 4,338,387, 4,286,033 and 4,291,110. The disclosures of U.S. Pat. Nos. 4,338,387, 4,286,033 and 4,291,110 are incorporated herein by reference in their entirety. A preferred blocking layer comprises a reaction product between a hydrolyzed silane and the oxidized surface of a metal ground plane layer. The blocking layer may be applied by any suitable conventional technique such as spraying, dip coating, draw bar coating, gravure coating, silk screening, air knife coating, reverse roll coating, vacuum deposition, chemical treatment and the like. The blocking layer should be continuous and have a thickness of less than about 0.2 micrometer because greater thicknesses may lead to undesirably high residual voltage.

An optional adhesive layer may applied to the hole blocking layer. Any suitable adhesive layer well known in the art may be utilized. Typical adhesive layer materials include, for example, polyesters, duPont 49,000 (available from E.I. duPont de Nemours and Company), Vitel PE100 (available from Goodyear Tire & Rubber), polyurethanes, and the like. Satisfactory results may be achieved with adhesive layer thickness between about 0.05 micrometer (500 angstroms) and about 0.3 micrometer (3,000 angstroms). Conventional techniques for applying an adhesive layer coating mixture to the charge blocking layer include spraying, dip coating, roll coating, wire wound rod coating, gravure coating, Bird applicator coating, and the like. Drying of the deposited coating may be effected by any suitable conventional technique such as oven drying, infra red radiation drying, air drying and the like.

Any suitable photogenerating layer comprising trigonal selenium particles dispersed in a film forming polymeric binder may be applied to the adhesive blocking layer which can then be overcoated with a contiguous hole transport layer as described hereinafter and the like dispersed in a film forming polymeric binder. Multi-photogenerating layer compositions may be utilized where a photoconductive layer enhances or reduces the properties of the photogenerating layer. Examples of this type of configuration are described in U.S. Pat. No. 4,415,639, the entire disclosure of this patent being incorporated herein by reference.

Any suitable polymeric film forming binder material may be employed as the matrix in the photogenerating binder layer. Typical polymeric film forming materials include those described, for example, in U.S. Pat. No. 3,121,006, the entire disclosure of which is incorporated herein by reference. Thus, typical organic polymeric film forming binders include thermoplastic and thermosetting resins such as polycarbonates, polyesters, polyamides, polyurethanes, polystyrenes, polyarylethers, polyarylsulfones, polybutadienes, polysulfones, polyethersulfones, polyethylenes, polypropylenes, polyimides, polymethylpentenes, polyphenylene sulfides, polyvinyl acetate, polysiloxanes, polyacrylates, polyvinyl acetals, polyamides, polyimides, amino resins, phenylene oxide resins, terephthalic acid resins, phenoxy resins, epoxy resins, phenolic resins, polystyrene and acrylonitrile copolymers, polyvinylchloride, vinylchloride and vinyl acetate copolymers, acrylate copolymers, alkyd resins, cellulosic film formers, poly(amideimide), styrenebutadiene copolymers, vinylidenechloride-vinylchloride copolymers, vinylacetate-vinylidenechloride copolymers, styrene-alkyd resins, polyvinylcarbazole, and the like. These polymers may be block, random or alternating copolymers.

The photogenerating trigonal selenium particles are present in the resinous binder composition in various amounts, generally, however, from about 5 percent by volume to about 90 percent by volume of the photogenerating trigonal selenium particles is dispersed in about 10 percent by volume to about 95 percent by volume of the resinous binder, and preferably from about 20 percent by volume to about 30 percent by volume of the photogenerating pigment is dispersed in about 70 percent by volume to about 80 percent by volume of the resinous binder composition. In one embodiment about 8 percent by volume of the photogenerating pigment is dispersed in about 92 percent by volume of the resinous binder composition. Preferably, the trigonal particles have an average particle size of less than about 0.1 micrometers.

The photogenerating layer generally ranges in thickness of from about 0.1 micrometer to about 5.0 micrometers, and preferably has a thickness of from about 0.3 micrometer to about 3 micrometers. The photogenerating layer thickness is related to binder content. Higher binder content compositions generally require thicker layers for photogeneration. Thicknesses outside these ranges can be selected providing the objectives of the present invention are achieved.

Any suitable and conventional technique may be utilized to mix and thereafter apply the photogenerating layer coating mixture. Typical application techniques include spraying, dip coating, roll coating, wire wound rod coating, and the like. Drying of the deposited coating may be effected by any suitable conventional technique such as oven drying, infra red radiation drying, air drying and the like.

The active charge transport layer of this invention comprises a charge generating layer and a charge transport layer, the charge transport layer comprising

- a protonic acid or Lewis acid,
- a charge transporting small molecule,
- a film forming polymer, and
- an additive selected from the group consisting of
  - 1-alkylpiperidene,
  - triethylamine,
  - a complex selected from the group consisting of
    - a complex of 1-alkylpiperidene and a protonic acid or Lewis acid, a complex of triethylamine and a protonic acid or Lewis acid and mixtures thereof.

Typical 1-alkylpiperidenes include, for example, 1-ethylpiperidine, 1-methylpiperidine, 1-propylpiperidine, and the like.

The charge transporting small molecule is dissolved or molecularly dispersed in the film forming polymer. The term "dissolved" as employed herein is defined herein as forming a solution in which the small molecule is dissolved in the polymer to form a homogeneous phase. The expression "molecularly dispersed" is used herein is defined as a charge transporting small molecule dispersed in the polymer, the small molecules being dispersed in the polymer on a molecular scale.

Any suitable charge transporting or electrically active arylamine small molecule may be employed in the charge transport layer of this invention. The expression charge transporting "small molecule" is defined herein as a monomer that allows the free charge photogenerated in the transport layer to be transported across the transport layer. Typical arylamine charge transporting small molecules include, for example, pyrazolines such as 1-phenyl-3-(4'-diethylamino styryl)-5-(4"-diethylamino phenyl) pyrazoline, diamines such as N,N'-diphenyl-N,N'-bis(3-methylphenyl)-(1,1-biphenyl)-4,4'-diamine, hydrazones such as N-phenyl-N-methyl-3-(9-ethyl) carbazyl hydrazone and r-diethyl amino benzaldehyde-1,2-diphenyl hydrazone, and oxadiazoles such as 2,5-bis (4-N,N'-diethylaminophenyl)-1,2,4-oxadiazole, stilbenes and the like. However, to avoid cycle-up, the charge transport layer should be substantially free of triphenyl methane. As indicated above, suitable electrically active small molecule charge transporting compounds are dissolved or molecularly dispersed in electrically inactive polymeric film forming materials. A small molecule charge transporting compound that permits injection of holes from the pigment into the charge generating layer with high efficiency and transports them across the charge transport layer with very short transit times is N,N'-diphenyl-N,N'-bis(3-methylphenyl)-(1,1'-biphenyl)-4,4'-di-amine.

Still other examples of electrically active small molecule charge transporting compounds include aromatic amine compounds represented by the following general formula:

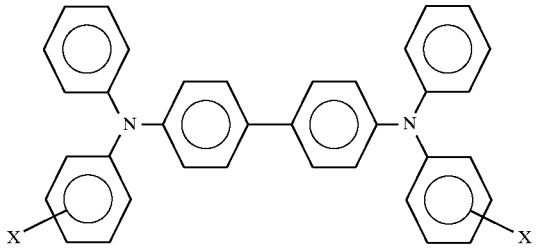

wherein X is selected from the group consisting of an alkyl group containing from 1 to 4 carbon atoms and chlorine. Examples of small molecule charge transporting aromatic amines represented by the structural formula above capable of supporting the injection of photogenerated holes and transporting the holes through the charge transport layer include N,N'-diphenyl-N,N'-bis(alkylphenyl)-(1,1'-biphenyl)-4,4'-diamine wherein the alkyl is, for example, methyl, ethyl, propyl, n-butyl, and the like, N,N'-diphenyl-N,N'-bis(chlorophenyl)-[1,1'-biphenyl]-4,4'-diamine, N,N'-diphenyl-N,N'-bis(3-methylphenyl)-(1,1'-biphenyl)-4,4'-diamine, and the like. The specific aromatic diamine charge transport layer compound illustrated in the formula above is described in U.S. Pat. No. 4,265,990, the entire disclosure thereof being incorporated herein by reference. Still other examples of aromatic diamine small molecule charge transport layer compounds include N,N,N',N'-tetraphenyl-[3,3'-dimethyl-1,1'-biphenyl]-4,4'-diamine; N,N'-diphenyl-N,N'-bis(2-methylphenyl)-[3,3' dimethyl-1,1'-biphenyl]-4,4'-diamine; N,N'-diphenyl-N,N'-bis(3-methylphenyl)-[3,3'-dimethyl-1,1'-biphenyl]-4,4'-diamine; N,N'-diphenyl-N,N'-bis(4-methylphenyl)-[3,3'dimethyl-1,1'-biphenyl]-4,4'-diamine; N,N,N',N'-tetra(2-methylphenyl)-[3,3'-dimethyl-1,1'-biphenyl]-4,4'-diamine; N,N'-bis(2-methylphenyl)-N,N'-bis(4-methylphenyl)-[3,3'-dimethyl-1,1'-biphenyl]-4,4'-diamine; N,N'-bis(3-methylphenyl)-N,N'-bis(2-methylphenyl)-[3,3'-dimethyl-1,1'-biphenyl]-4,4'-diamine; N,N,N',N'-tetra(3-methylphenyl)-[3,3'-dimethyl-1,1'-biphenyl]-4,4'-diamine; N,N'-bis(3-methylphenyl)-N,N'-bis (4-methylphenyl)-[3,3'-dimethyl-1,1'-biphenyl]-4,4'-diamine; and N,N,N',N'-tetra(4-methylphenyl)-[3,3'-dimethyl-1,1'-biphenyl]-4,4'-diamine. The aromatic diamine small molecule charge transport layer compounds illustrated above are described in U.S. Pat. No. 4,299,897, the entire disclosure thereof being incorporated herein by reference. Additional examples of small molecule charge transporting compounds include: N,N,N',N'-Tetra-(4-methylphenyl)-[3,3'-dimethyl-1,1'-biphenyl]-4,4'-diamine; N,N'-diphenyl-N,N'-bis(4-methylphenyl)-[3,3'-dimethyl-1,1'-biphenyl]-4,4'-diamine; and N,N'-bis(4-methylphenyl)-N,N'-bis(4-ethylphenyl)-[3,3'-dimethyl-1,1'-biphenyl]-4,4'- diamine. The second of these two specific small molecule aromatic diamine charge transport layer compounds is described in U.S. Pat. No. 4,299,897, the entire disclosure thereof being incorporated herein by reference. The substituents on both the first and second types of aromatic diamine molecules should be free from electron withdrawing groups such as $NO_2$ groups, CN groups, and the like. Other typical arylamine small molecules are described in U.S. Pat. No. 4,725,518, the entire disclosure thereof being incorporated herein by reference.

Preferably, the dried charge transport layer comprises between about 30 and about 60 percent by weight of the small molecule charge transporting compound, based on the total weight of the dried charge transport layer.

Any suitable electrically inert film forming polymeric binder may be used to disperse the electrically active molecule in the charge transport layer. Typical inert polymeric binders include, for example, poly (4,4'-isopropylidene-diphenylene) carbonate (also referred to as bisphenol-A-polycarbonate), poly (4,4'-isopropylidene-diphenylene) carbonate, poly (4,4'-diphenyl-1,1'-cyclohexane carbonate), and the like. Other typical inactive resin binders include polyaryl ketones, polyester, polyarylate, polyacrylate, polyether, polysulfone, and the like. Weight average molecular weights can vary, for example, from about 20,000 to about 150,000. However, weight average molecular waits outside this range may be utilized where suitable. The film forming binders and other components used to form the charge transport layer should be soluble in the solvent utilized to apply the charge transport layer coatings.

Preferably, the dried charge transport layer comprises between about 40 and about 70 percent by weight of the film forming polymer, based on the total weight of the dried charge transport layer.

Any suitable solvent may be used for the charge transport coating mixture. Typical solvents include, for example, methylene chloride, tetrahydrofuran, toluene and monochloro benzene, and the like. The solvent selected should dissolve all of the components used to form the charge transport layer. A preferred solvent is methylene chloride. Generally, the amount of solvent used depends upon the type of coating technique employed. For example, less solvent is used for dip or immersion coating than for extrusion coating. Typically, depending upon the coating process selected, the amount of solvent ranges from about 70 percent by weight to about 90 percent by weight based on the total weight of the coating mixture.

It has been found that a compound, 1-ethylpiperidine is a very potent additive to the charge transport layer in that it improves the doping latitude for trifluoroacetic acid doping at about 2 ppm of 1-ethylpiperidine, based on the weight of the film forming resin. However, at greater than 5 ppm of 1-ethylpiperidine (based on the weight of the film forming resin), high background and signs of possible cycle-up may result unless significantly more trifluoroacetic acid is added to compensate for its effects. Due to the low doping levels and relatively narrow range required for trifluoroacetic acid, 1-ethylpiperidine care must be taken to avoid doping errors, particularly at production level volumes.

It has also been unexpectedly been found that the trifluoroacetic acid doping latitude of the inferior acid doping polycarbonate film forming polymers can be markedly improved by the addition of a complex of an acid such as trifluoroacetic acid (TFA) and a 1-alkylperidine such as 1-ethylpiperidine, (EP). Other 1-alkylperidine materials such as 1-methylpiperidine, 1-propylpiperidine or triethylamine and their complex with acids can be used. Thus, an additive less sensitive than 1-ethylpiperidine with a wider operating range is achieved with the preferred complex. The complex, when added to a solution of small molecule polyarylamine transport material dissolved in a solvent, at a concentration of between about 5 ppm and about 15 ppm, based on the weight of the film forming polymer, allows more than about 10 ppm trifluoroacetic acid (based on the weight of the solvent) to be added during coating of the transport layer to eliminate edge spike and still bring image potential within about 20 volts without cycle-up or high background. Moreover, photoreceptors made with an EP-TFA complex at, for example, about 10 ppm (based on the weight of the film forming polymer) have passed environmental testing in the three zones of interest. These include A (~80F, 80% RH), ambient B zone (~70F, 40% RH) and C zones (~60F, 15% RH). using a cyclic electrical scanner without differing from a control photoreceptor (identical except that it does not contain the complex). Thus, the salt complex does not display deleterious water absorption effects at the level of concentrations required. Due to the wide range of acceptable doping levels, the trifluoroacetic acid doping latitude of the EP-TFA complex is more controllable compared with that of 1-ethylpiperidine at production levels. The mechanism of the EP-TFA complex in improving trifluoroacetic acid doping latitude is not understood at this time. Because the 1-ethylpiperidine is already neutralized by trifluoroacetic acid and because trifluoroacetic acid is added in amounts of an order of magnitude greater than the amount of 1-ethylpiperidine in the complex, this high acid doping effect is not due to simple neutralization of the acid by a base. The scope of the concept might be extended to include other amine salt complexes to improve trifluoroacetic acid doping latitude as well. These include, for example, 1-methylpiperidine, 1-propylpiperidine, triethylamine complexes with trifluoroacetic and other acid complexes. The expression "complex" as employed herein is defined as salt of a base with an acid and it can be a low melting solid or oil and it can be colored or not, typically slightly yellowish.

Any suitable stable protonic acid or Lewis acid or mixture thereof soluble in methylene chloride or other suitable solvent may be employed as a dopant in the transport layer of this invention to control dark decay and background potential. Stable protonic acids and Lewis acids do not decompose or form a gas at the temperatures and conditions employed in the preparation and use of the final multilayer photoconductor. Thus, protonic acids and Lewis acids having a boiling point greater than about 40° C. are especially preferred for greater stability during storage, transportation and operating conditions. Protonic acids generally are acids in which a proton ($H^+$) is available. Organic protonic acids include, for example, those having the following structural formulae:

$R_5$—COOH wherein $R_5$ is H or a substituted or unsubstituted alkyl group containing from 1 to 12 carbon atoms;

$R_6$—$SO_3H$ wherein $R_6$ is substituted or unsubstituted alkyl or aryl group containing from 1 to 18 carbon atoms;

$R_7$—COOH wherein $R_7$ is a substituted or unsubstituted cycloaliphatic or cycloaliphatic-aromatic group containing from 4 to 12 carbon atoms;

$R_8$—$SO_2H$ wherein $R_8$ is a substituted or unsubstituted alkyl, aryl, cycloalkyl group containing from 1 to about 12 carbon atoms; and

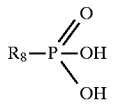

wherein $R_8$ is defined above

Typical organic protonic acids represented by these formulas having a boiling point greater than about 40° C. and that are soluble in methylene chloride or other suitable solvent include trifluoroacetic acid, trichloroacetic acid, methane sulfonic acid, acetic acid, nitrobenzoic acid, benzene-sulfonic acid, benzene-phosphonic acid, trifluoro methane sulfonic acid, and the like and mixtures thereof. Optimum results are achieved with trifluoroacetic acid and trichloroacetic acid because of good solubility, acid strength and in case of $CF_3COOH$ good chemical stability. Inorganic protonic acids include halogen, sulfur, selenium tellurium or phosphorous containing inorganic acids. Typical inorganic protonic acids include $H_2SO_4$, $H_3PO_4$, $H_2SeO_3$, $H_2SeO4$. Other less preferred inorganic protonic acids having boiling point less than 40° C. include HCl, HBr, Hl, and the like and mixtures thereof.

Lewis acids generally are electron acceptor acids which can combine with another molecule or ion by forming a covalent chemical bond with two electrons from the second molecule or ion. Typical Lewis acids include aluminum trichloride, ferric trichloride, stannic tetrachloride, boron trifluoride, $ZnCl_2$, TiCl4, $SbCl_5$, $CuCl_2$, $SbF_5$, $VCl_4$, $TaCl_5$, $ZrCl_4$, and the like and mixtures thereof. The protonic acids and Lewis acids should preferably have a boiling point greater than about 40° C. to avoid loss of the acid dopant during preparation, storage, transportation or use at higher temperatures. Acids of lower boiling points than 40° C. may be used where practical. These protonic acids and Lewis acids are described in U.S. Pat. No. 4,725,518, the entire disclosure thereof being incorporated herein by reference.

Any suitable and conventional technique may be utilized to mix and thereafter apply the charge transport layer coating mixture to the charge generating layer. Typical application techniques include spraying, dip coating, roll coating, wire wound rod coating, and the like. Drying of the deposited coating may be affected by any suitable conventional technique such as oven drying, infra red radiation drying, air drying and the like.

Generally, the dry thickness of the charge transport layer is between about 10 and about 50 micrometers, but thicknesses outside this range can also be used. The hole transport layer should be an insulator to the extent that the electrostatic charge placed on the hole transport layer is not conducted in the absence of illumination at a rate sufficient to prevent formation and retention of an electrostatic latent image thereon. In general, the ratio of the thickness of the hole transport layer to the charge generator layers is preferably maintained from about 2:1 to 200:1 and in some instances as great as 400:1. In other words, the charge transport layer is substantially non-absorbing to visible light or radiation in the region of intended use but is electrically "active" in that it allows the injection of photogenerated holes from the photoconductive layer, i.e., charge generation layer, and allows these holes to be transported through itself to selectively discharge a surface charge on the surface of the active layer.

The photoreceptors of this invention may comprise, for example, a charge generator layer sandwiched between a conductive surface and a charge transport layer as described above or a charge transport layer sandwiched between a conductive surface and a charge generator layer. This structure may be imaged in the conventional xerographic manner which usually includes charging, optical exposure and development.

Other layers may also be used such as conventional electrically conductive ground strip along one edge of the belt or drum in contact with the conductive layer, blocking layer, adhesive layer or charge generating layer to facilitate connection of the electrically conductive layer of the photoreceptor to ground or to an electrical bias. Ground strips are well known and usually comprise conductive particles dispersed in a film forming binder.

Optionally, an overcoat layer may also be utilized to improve resistance to abrasion. In some cases an anti-curl back coating may be applied to the side opposite the photoreceptor to provide flatness and/or abrasion resistance. These overcoating and anti-curl back coating layers are well known in the art and may comprise thermoplastic organic polymers or inorganic polymers that are electrically insulating or slightly semi-conductive. Overcoatings are continuous and generally have a thickness of less than about 10 micrometers.

A number of examples are set forth hereinbelow and are illustrative of different compositions and conditions that can be utilized in practicing the invention. All proportions are by weight unless otherwise indicated. It will be apparent, however, that the invention can be practiced with many types of compositions and can have many different uses in accordance with the disclosure above and as pointed out hereinafter.

EXAMPLE I

Several photoreceptors were prepared by forming coatings using conventional techniques on a substrate comprising a vacuum deposited titanium layer on a polyethylene terephthalate film (Melinex®, available from E .I. duPont Nemours & Co.). The first coating was a siloxane barrier layer formed by hydrolyzed gamma aminopropyltriethoxysilane having a thickness of 100 angstroms. The second coating was an adhesive layer of polyester resin (49,000, available from E. I. duPont de Nemours & Co.) having a thickness of 50 angstroms. The next coating was a charge generator layer coated from a solution containing 0.8 gram trigonal selenium having a particle size of about 0.05 micrometer to 0.2 micrometer and about 0.8 gram poly(N-vinyl carbazole) in about 7 millimeters of tetrahydrofuran and about 7 milliliters toluene. The generator layer coating was applied with a 0.005 inch Bird applicator and the layer was dried at about 135° C. in a forced air oven to form a layer having a 1.6 micrometer thickness.

EXAMPLE II

Six of the photogenerator layers of trigonal selenium of Example I were coated with transport layer consisting of 50 weight percent (based on the total weight of solids) N,N'-diphenyl-N,N'-bis(3-methyl-phenyl)-(1,1'biphenyl)-4,4'-diamine (TPD) and 50 weight percent (based on the total weight of solids) polycarbonate resin a poly (4,4'-isopropylidene-diphenylene) carbonate (Makrolon®, available from Farbenfabricken Bayer A.G.) and X parts per million of trifluoroacetic acid (based on the weight of methylene chloride) and Y ppm of 1-ethylpiperidine (based on the weight of polycarbonate) applied as a solution in methylene chloride. The coated devices were heated in an oven maintained at from 40° C. to 100° C. over 30 minutes to form a charge transport layer having a thickness of 25 micrometers. The composition of the six transport layers are shown in Table I.

TABLE I

| Device # | Makrolon wt. % | TPD wt. % | TFA ppm | 1-ethylpiperidine ppm |
|---|---|---|---|---|
| 1 | 50 | 50 | 0 | 0 |
| 2 | 50 | 50 | 10 | 0 |
| 3 | 50 | 50 | 0 | 10 |
| 4 | 50 | 50 | 10 | 10 |
| 5 | 50 | 50 | 0 | 100 |
| 6 | 50 | 50 | 10 | 100 |

EXAMPLE III

The flexible photoreceptor sheets prepared as described in Example II were tested for their xerographic sensitivity and cyclic stability in a scanner. In the scanner, each photoreceptor sheet to be evaluated was mounted on a cylindrical aluminum drum substrate which was rotated on a shaft. The device was charged by a corotron mounted along the periphery of the drum. The surface potential was measured as a function of time by capacitively coupled voltage probes placed at different locations around the shaft. The probes were calibrated by applying known potentials to the drum substrate. Each photoreceptor sheet on the drum was exposed by a light source located at a position near the drum downstream from the corotron. As the drum was rotated, the initial (pre-exposure) charging potential was measured by voltage probe 1. Further rotation lead to the exposure station, where the photoreceptor device was exposed to monochromatic radiation of known intensity. The device was erased by a light source located at a position upstream of charging. The measurements made included charging of the photoconductor device in a constant current or voltage mode. The device was charged to a negative polarity corona. As the drum was rotated, the initial charging potential was measured by voltage probe 1. Further rotation lead to the exposure station, where the photoreceptor device was exposed to monochromatic radiation of known intensity. The surface potential after exposure was measured by voltage probes 2 and 3. The device was finally exposed to an erase lamp of appropriate intensity and any residual potential was measured by voltage probe 4. The process was repeated with the magnitude of the exposure automatically changed during the next cycle. The photodischarge characteristics was obtained by plotting the potentials at voltage probes 2 and 3 as a function of light exposure. The charge acceptance and dark decay were also measured in the scanner. The results can be summarized as follows: Device #3 slightly desensitizes the device as compared to control Device #1; Devices #3 and #4 show that TFA latitude of the control Device #1 has been increased substantially; results for Devices #5 and #6 indicate that the latitude of the doping with 1-ethylpipperidine is very robust.

EXAMPLE IV

Preparation of the 1-ethylpiperidine—trifluoroacetic acid complex:

A 3-liter, 3-neck, round bottom flask situated in ice bath and equipped with a mechanical stirrer, argon inlet, addition funnel and condenser was charged with 1-ethylpiperidine (249.1 gm) and methyene chloride (1010 gm). To this was added dropwise in a steady stream, trifluoroacetic acid (251.5 gm) in methylene chloride (513 gm) over 4 hours. The solvent was removed using a rotary evaporator using first an aspirator for reduced pressure and then a vacuum pump over 5 hours. The resultant orange-yellow oil was transferred to a 500 mL bottle which then contained 488.3 grams of 1-ethylpiperidine-trifluoroacetic acid complex. The oil eventually crystallized to a solid mass which can be melted under hot tap water.

EXAMPLE V

The 1-ethylpipperidine-trifluroacetic acid complex of Example IV (0.10 gm) was diluted with methylene chloride (99.9 gm) and added to 10 microliters of a charge transport solution of polycarbonate (1.2 gm) (Makrolon®, available from Farbenfabricken Bayer A.G) and TPD (1.2 gm) in methylene chloride (13.45 gm). To this solution was added 10 microliters of trifluoroacetic acid solution made by diluting 1 gram of trifluoroacetic acid with 99 grams of methylene chloride. The resulting solution was coated onto a generator layer of trigonal selenium of Example I using a 4 mil Bird applicator bar, and the composite was heated in an oven from 40° C. to 100° C. over 30 minutes. This device was compared with the devices #1 and 2 of Example II. Electrical scanning results show that the TFA doping latitude of the device containing the transport layer doped with 1-ethylpipperidine-trifluroacetic acid complex was markedly improved over those without the complex. Moreover, there was no cycle-up or increase in background voltage as the device was cycled through 10,000 cycles.

TABLE II

Electrical Improvement With Respect To Devices In Example II

| With respect to (development in Example II) | Increase in background at 3.8 ergs/cm$^2$ [V] | Reduction in depletion [V] | Reduction in dark decay (1 sec) [V] |
|---|---|---|---|
| Device # 1 (0 ppm TFA) | 62 | 78 | 40 |
| Device # 2 (10 ppm TFA) | 50 | 54 | 71 |

TABLE III

Cycling Stability For Device With 10 ppm TFA For 50k Cycles

| Device | Change in background [V] | Change in depletion [V] | Change in dark decay (1 sec) [V] |
|---|---|---|---|
| Control | 20 | −5 | −3 |
| Doped device | 12 | −18 | 102 |

Note to dark decay: Control device started out with high dark decay; hence, the little change. At 50 k cycles the absolute values are 385 V and 336 V for control and doped devices, respectively.

Although the invention has been described with reference to specific preferred embodiments, it is not intended to be limited thereto, rather those having ordinary skill in the art will recognize that variations and modifications may be made therein which are within the spirit of the invention and within the scope of the claims.

What is claimed is:

1. An electrophotographic imaging member comprising a charge generating layer comprising trigonal selenium particles and a charge transport layer, the charge transport layer comprising a protonic acid or Lewis acid, a charge transporting small molecule, a film forming polymer, and an additive selected from the group consisting of 1-alkylpiperidine, triethylamine, a complex of 1-alkylpiperidene and a protonic acid or Lewis acid, a complex of triethylamine and a protonic acid or Lewis acid and mixtures thereof.

2. An electrophotographic imaging member according to claim 1 wherein the film forming polymer is a polycarbonate.

3. An electrophotographic imaging member according to claim 1 wherein the charge transport layer comprises between about 5 ppm and about 15 ppm by weight of the complex of 1-alkylpiperidine and protonic acid or Lewis acid, based on the weight of the film forming polymer.

4. An electrophotographic imaging member according to claim 1 wherein the charge transport layer comprises between about 5 ppm and about 20 ppm by weight of the protonic acid or Lewis acid, based on the weight of solvent employed to form the charge transport layer.

5. An electrophotographic imaging member according to claim 1 wherein the charge transport layer comprises between about 30 and about 60 percent by weight of the charge transporting small molecule, based on the total weight of the dried charge transport layer.

6. An electrophotographic imaging member according to claim 1 wherein the charge transporting small molecule comprises an aromatic amine compound.

7. An electrophotographic imaging member according to claim 1 wherein the charge transport layer comprises between about 40 and about 70 percent by weight of the film forming binder, based on the total weight of the dried charge transport layer.

8. An electrophotographic imaging member according to claim 1 wherein the charge transporting layer has a dry thickness of between about 10 and about 50 micrometers.

9. An electrophotographic imaging member according to claim 1 wherein the charge transport layer comprises between about 5 ppm and about 15 ppm by weight of the 1-alkylpiperidine, based on the weight of the film forming polymer.

10. A process for fabricating an electrophotographic imaging member comprising providing a charge generating layer comprising trigonal selenium particles, forming a charge transporting layer coating composition to the charge generating layer, the coating composition comprising a charge generating layer and a charge transport layer, the charge transport layer comprising a protonic acid or Lewis acid, a charge transporting small molecule, a film forming polymer, a solvent, and an additive selected from the group consisting of 1-alkylpiperidine, triethylamine, a complex of 1-alkylpiperidene and a protonic acid or Lewis acid, a complex of triethylamine and a protonic acid or Lewis acid and mixtures thereof, and drying the coating to form a charge transporting layer.

11. A process for fabricating an electrophotographic imaging member according to claim 10 wherein charge transporting layer coating composition comprises between about 5 ppm and about 15 ppm of the complex, based on the weight of the film forming polymer.

12. A process for fabricating an electrophotographic imaging member according to claim 11 wherein charge transporting layer coating composition comprises between about 5 ppm and about 15 ppm of the complex, based on the weight of the film forming polymer.

13. A process for fabricating an electrophotographic imaging member according to claim 11 wherein charge transporting layer coating composition comprises at least about 5 ppm of the trifluoroacetic acid, based on the weight of the solvent.

14. A process for fabricating an electrophotographic imaging member according to claim 11 wherein charge transporting layer coating composition comprises between about 5 ppm and about 20 ppm of the trifluoroacetic acid, based on the weight of the solvent.

15. A process for fabricating an electrophotographic imaging member according to claim 10 wherein charge transporting layer coating composition comprises between about 5 ppm and about 15 ppm of the 1-alkylpiperidine, based on the weight of the film forming polymer.

16. A process for fabricating an electrophotographic imaging member according to claim 15 wherein the 1-alkylpiperidine is 1-ethylpiperidine.

17. A process for fabricating an electrophotographic imaging member according to claim 10 wherein the solvent is methylene chloride.

18. A process for fabricating an electrophotographic imaging member according to claim 10 wherein the acid is trifluoroacetic acid.

* * * * *